US006324867B1

(12) United States Patent
Fanning et al.

(10) Patent No.: US 6,324,867 B1
(45) Date of Patent: Dec. 4, 2001

(54) PROCESS AND SYSTEM FOR LIQUEFYING NATURAL GAS

(75) Inventors: Robert A. Fanning, Highland Village, TX (US); Brett L. Ryberg, Tokyo (JP); Bruce K. Smith, South Lake; Luan D. Phan, Garland, both of TX (US)

(73) Assignee: ExxonMobil Oil Corporation, Irving, TX (US)

( * ) Notice: Subject to any disclaimer, the term of this patent is extended or adjusted under 35 U.S.C. 154(b) by 0 days.

(21) Appl. No.: 09/574,940

(22) Filed: May 18, 2000

Related U.S. Application Data

(60) Provisional application No. 60/139,308, filed on Jun. 15, 1999.

(51) Int. Cl.[7] ..... F25J 1/00
(52) U.S. Cl. ..... 62/613; 60/728; 62/912
(58) Field of Search ..... 62/611, 612, 613, 62/912; 60/728

(56) References Cited

U.S. PATENT DOCUMENTS

| | | | |
|---|---|---|---|
| 3,257,813 | | 6/1966 | Hashemi-Tafreshi . |
| 3,323,315 | | 6/1967 | Carr . |
| 3,971,210 | * | 7/1976 | Rose ..... 60/728 |
| 4,418,527 | | 12/1983 | Schlom et al. . |
| 4,566,885 | | 1/1986 | Haak . |
| 5,139,548 | | 8/1992 | Liu et al. . |
| 5,203,161 | | 4/1993 | Lehto . |
| 5,321,944 | | 6/1994 | Bronicki et al. . |
| 5,400,588 | | 3/1995 | Yamane et al. . |
| 5,444,971 | | 8/1995 | Holenberger . |
| 5,450,728 | | 9/1995 | Vora et al. . |
| 5,457,951 | | 10/1995 | Johnson et al. . |
| 5,622,044 | | 4/1997 | Bronicki et al. . |
| 5,626,019 | | 5/1997 | Shimizu et al. . |
| 5,632,148 | | 5/1997 | Bronicki et al. . |
| 5,666,800 | | 9/1997 | Sorensen et al. . |
| 5,678,408 | | 10/1997 | Janes . |
| 5,724,806 | | 3/1998 | Horner . |
| 5,758,502 | | 6/1998 | Utamura et al. . |
| 5,782,093 | | 7/1998 | Yamashita et al. . |
| 5,806,298 | | 9/1998 | Klosek et al. . |

OTHER PUBLICATIONS

"The Refrigerated Gas and Vapor Turbine Cycle", J.H. Anderson et al; 87.GT–15, ASME, 1987.

"The Anderson Quin Cycle", J.H. Anderson et al; US DOE; Grant #DE–FG01–91CE15535; Final Report; Mar. 19, 1993.

* cited by examiner

*Primary Examiner*—Ronald Capossela
(74) *Attorney, Agent, or Firm*—Drude Faulconer; Marcy Hoefling

(57) ABSTRACT

A natural gas liquefaction system and process wherein excess refrigeration available in a typical natural gas liquefaction system is used to cool the inlet air to gas turbines in the system to thereby improve the overall efficiency of the system. A cooler is positioned in front of the air inlet of each gas turbine; and coolant (e.g. water) is flowed through each of the coolers to cool the ambient air as it flows into the gas turbines. The water, in turn, is cooled with propane taken from a refrigerant circuit in the system which, in turn, is used to initially cool the natural gas which is to be liquefied.

9 Claims, 3 Drawing Sheets

PROCESS AND SYSTEM FOR LIQUEFYING NATURAL GAS

CROSS-REFERENCE TO EARLIER APPLICATION

The present application claims the priority of Provisional Patent Application Ser. No. 60/139,308, filed Jun. 15, 1999.

DESCRIPTION

1. Technical Field

The present invention relates to a process and system for liquefying natural gas and in one aspect relates to a process and system for liquefying natural gas wherein the air to the power turbines used in the system is cooled by excess refrigeration from within the system to thereby improve the operating efficiency of the turbines and hence, the overall efficiency of the system.

2. Background

Most Liquid Natural Gas ("LNG") plants constructed in the last 20 years or so have used industrial gas turbines to drive the refrigeration compressors required to liquefy the natural gas. Typically, these gas turbines have inlet air filters but do not include any means for cooling the inlet air to the turbines. It well known that the amount of power available from a gas turbine is, in part, a function of the inlet air temperature; see "The Refrigerated Gas and Vapor Turbine Cycle", J. Hilbert Anderson and F. M. Laucks, 87-GT-15, ASME, 1987; "The Anderson Quin Cycle", J. Hilbert Anderson and W. M. Bilbow, U.S. Department of Energy, Grant #DE-FG01-91CE15535, Final Report, Mar. 19, 1993; U.S. Pat. No. 4,418,527, issued Dec. 6, 1983.

Since the temperature and density of the inlet air changes with the ambient temperature, the amount of power available from a particular turbine varies from day to night and from summer to winter. This change in available power can be quite large; e.g. at times the power available during the hottest summer day can sometimes be less than about 70% of the power available during the coolest winter night. Also, the horsepower from the turbine needed to provide the required refrigeration in an LNG process increases as the heat sink temperature increases (i.e. seawater or air). Due to these varying factors, the gas turbines used in a typical LNG plant usually include gas turbines large enough to supply the required horsepower when operating at the warmest ambient temperatures even though they may only operate at these temperature for short periods of time. This means that most LNG plants have to be significantly overdesigned in order to insure that the required horsepower is always available regardless of the then current ambient temperature.

The effect that the temperature of the inlet air has on the power output of a gas turbine in an LNG process has been recognized. For example, the gas liquefaction system disclosed in U.S. Pat. No. 4,566,885, issued Jan. 28, 1986, is designed with gas turbines large enough to provide the necessary horsepower to liquefy LNG even when operating at the maximum (i.e. warmest) expected ambient temperature. If and when the ambient temperature cools off from this maximum temperature, the turbines can generate additional power which, in turn, can then be used to drive a generator to produce additional electrical power. While this system recovers some of the excess power from the turbines, it still requires unnecessarily large turbines which significantly add to the capital and maintenance costs involved.

Another LNG process in which the temperature of the inlet air to the turbines is used to improve the operation thereof is disclosed in U.S. Pat. No. 5,139,548, issued Aug. 18, 1992 wherein the ambient temperature of the inlet air is periodically predicted. Each predicted temperature is then used to optimize the operating conditions for the system, e.g. minimize the fuel consumption by the turbines at a given LNG production rate. Again, the turbines used in this system must be large enough to produce the horsepower needed at the warmest ambient temperature even though some of the costs can be recouped by reducing the fuel consumption during cooler periods.

While cooling the inlet air for turbines is used in a variety of known commercial operations, e.g. electrical power generation, air conditioning, ice making, etc.; see U.S. Pat. Nos. 5,203,161; 5,321,944; 5,444,971; 5,457,951; 5,622,044; 5,626,019; 5,666,800; 5,758,502; and 5,806,298, it has not found use in gas liquefaction processes such as LNG processes wherein the costs of the turbines required to furnish the power in such operations is a significant factor in the capital and operating costs of the system. With LNG becoming a more important energy source each year, there exists a real need for improving the efficiency of the LNG processes and reducing their costs in order to deliver LNG to market at a competitive price.

SUMMARY OF THE INVENTION

The present invention provides a natural gas liquefaction (LNG) system and process wherein excess refrigeration available in a typical LNG system is used to cool the inlet air to the gas turbines in the system thereby improving the overall efficiency of the system. By maintaining the inlet air for the gas turbines at a constant low temperature, the amount of power generated by the turbines remains at a high level regardless of the ambient air temperature. This allows a LNG plant to be designed for more capacity and allows the plant to operate at a constant production rate throughout the year. Further, since the present invention utilizes the propane circuit which is already present in LNG systems of this type, no additional cooling source is required to carry out the invention.

More specifically, the present invention is especially useful in LNG systems which use first and second closed circuits of first and second refrigerants to cool a feed gas to the low temperatures needed for liquefaction. The first closed circuit carries a first refrigerant (e.g. propane) which is used to initially cool the feed gas (e.g. natural gas). This first circuit, in addition to the necessary heat exchanger needed for cooling the feed gas, also includes a first gas turbine which drives a first compressor which, in turn, compresses and circulates the propane through the first closed circuit. The second closed refrigerant circuit carries a mixed refrigerant "MR" (e.g. nitrogen, methane, ethane, and propane) for further cooling the feed gas to the final low temperature required to produce LNG. The mixed refrigerant is compressed and circulated through the second closed refrigerant circuit by a second compressor which is driven by a second gas turbine.

In accordance with the present invention, the above described LNG system further includes a means for cooling the inlet air to the respective gas turbines. This means is comprised of (1) a cooler positioned in front of the air inlet of each of the respective gas turbines and (2) a closed coolant circuit which is in fluid communication with each of the coolers. Coolant (e.g. water) flows through each of the coolers to cool the ambient air as air flows therethrough and into the turbines.

The closed coolant circuit includes a heat exchanger which is fluidly connected to the first refrigerant circuit whereby at least a portion of the propane in the first refrigerant circuit will flow through the heat exchanger to cool the water in said closed coolant circuit. Preferably, the ambient air is cooled to a temperature no lower than about 5° C. (41° F.) in order to prevent icing in the system. An anti-freeze agent (e.g. ethylene glycol) with corrosion inhibitors can be added to the water as needed.

BRIEF DESCRIPTION OF THE DRAWINGS

The actual construction, operation, and advantages of the present invention will be better understood by referring to the drawings, not necessarily to scale, in which like numerals identify like parts and in which.

While the invention will be described in connection with its preferred embodiments, it will be understood that this invention is not limited thereto. On the contrary, the invention is intended to cover all alternatives, modifications, and equivalents which may be included within the spirit and scope of the invention, as defined by the appended claims.

BEST KNOWN MODE FOR CARRYING OUT THE INVENTION

Figure 1:
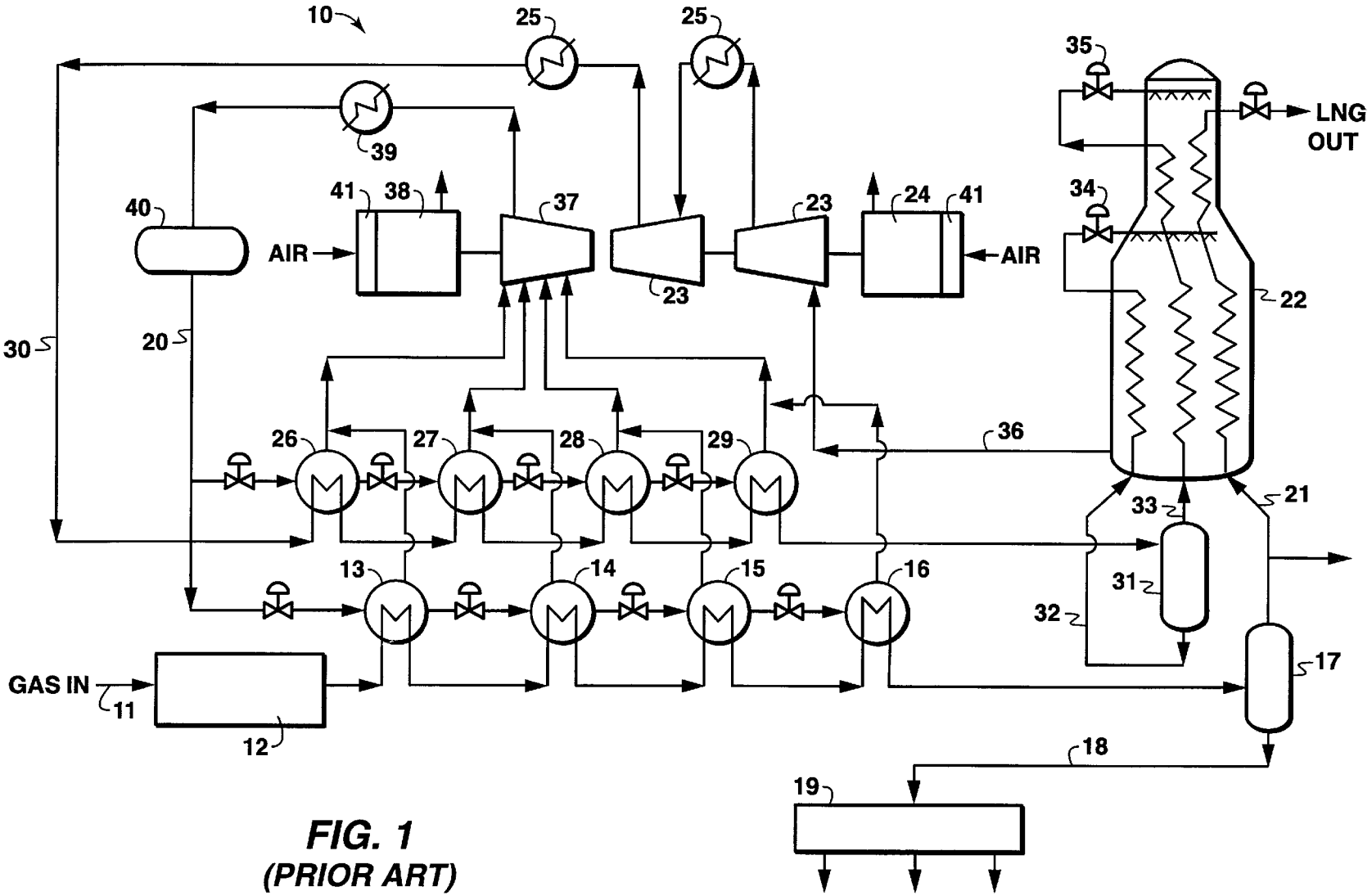
FIG. 1 (PRIOR ART)
FIG. 1 (PRIOR ART) is a flow diagram of a typical system for liquefying natural gas (LNG)

Referring more particularly to the drawings, FIG. 1 illustrates a typical, known system 10 and process for liquefying natural gas (LNG). In system 10, feed gas (natural gas) enters through inlet line 11 into a preparation unit 12 where it is treated to remove contaminants. The treated gas then passes from unit 12 through a series of heat exchangers 13, 14, 15, 16, where it is cooled by evaporating propane which, in turn, is flowing through the respective heat exchangers through propane circuit 20. The cooled natural gas then flows to fractionation column 17 wherein pentanes and heavier hydrocarbons are removed through line 18 for further processing in fractionating unit 19.

The remaining mixture of methane, ethane, propane, and butane is removed from fractionation column 17 through line 21 and is liquefied in the main cryogenic heat exchanger 22 by further cooling the gas mixture with a mixed refrigerant (MR) which flows through MR circuit 30. The MR is a mixture of nitrogen, methane, ethane, and propane which is compressed in compressors 23 which, in turn, are driven by gas turbine 24. After compression, the MR is cooled by passing it through air or water coolers 25 and is then partly condensed within heat exchangers 26, 27, 28, and 29 by the evaporating propane from propane circuit 20. The MR is then flowed to high pressure MR separator 31 wherein the condensed liquid (line 32) is separated from the vapor (line 33). As seen in FIG. 1, both the liquid and vapor from separator 31 flow through main cryogenic heat exchanger 22 where they are cooled by evaporating MR.

The cold liquid stream in line 32 is removed from the middle of heat exchanger 22 and the pressure thereof is reduced across expansion valve 34. The now low pressure MR is then put back into exchanger 22 where it is evaporated by the warmer MR streams and the feed gas stream in line 21. When the MR vapor steam reaches the top of heat exchanger 22, it has condensed and is removed and expanded across expansion valve 35 before it is returned to the heat exchanger 22. As the condensed MR vapor falls within the exchanger 22, it is evaporated by exchanging heat with the feed gas in line 21 and the high pressure MR stream in line 32. At the middle of exchanger 22, the falling condensed MR vapor mixes with the low pressure MR liquid stream within the exchanger 22 and the combined stream exits the bottom exchanger 22 as a vapor through outlet 36 to flow back to compressors 23 to complete MR circuit 30.

Closed propane circuit 20 is used to cool both the feed gas and the MR before they pass through main cryogenic heat exchanger 22. Propane is compressed by compressor 37 which, in turn, is powered by gas turbine 38. The compressed propane is condensed in coolers 39 (e.g. seawater or air cooled) and is collected in propane surge tank 40 from which it is cascaded through the heat exchangers (propane chillers) 13–16 and 26–29 where it evaporates to cool both the feed gas and the MR, respectively. Both gas turbines 24 and 38 have air filters 41 but neither have any means for cooling the inlet air.

Figure 2:
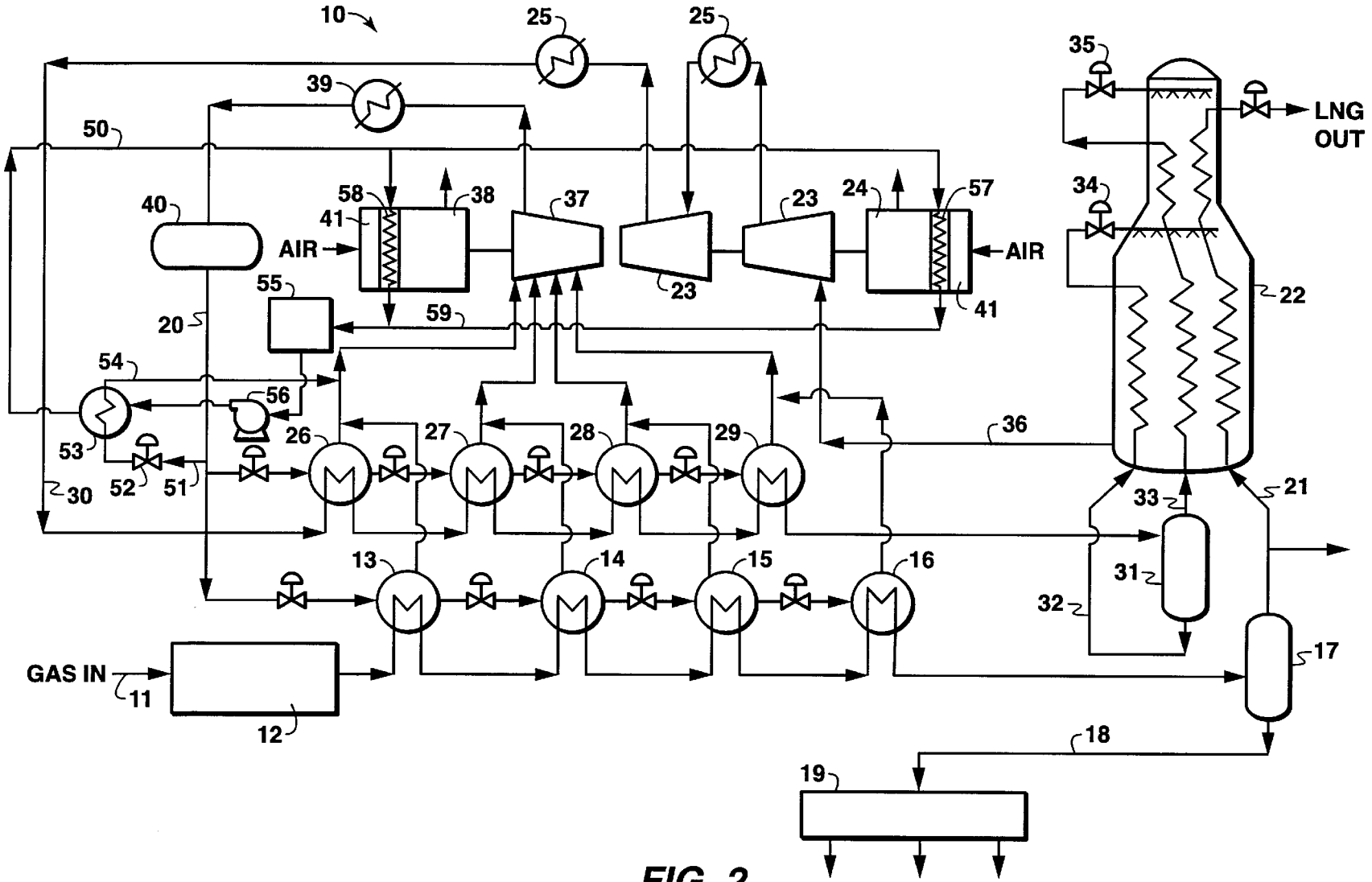
FIG. 2 is a flow diagram of the system for liquefying natural gas )LNG) in accordance with the present invention.
Figure 3:
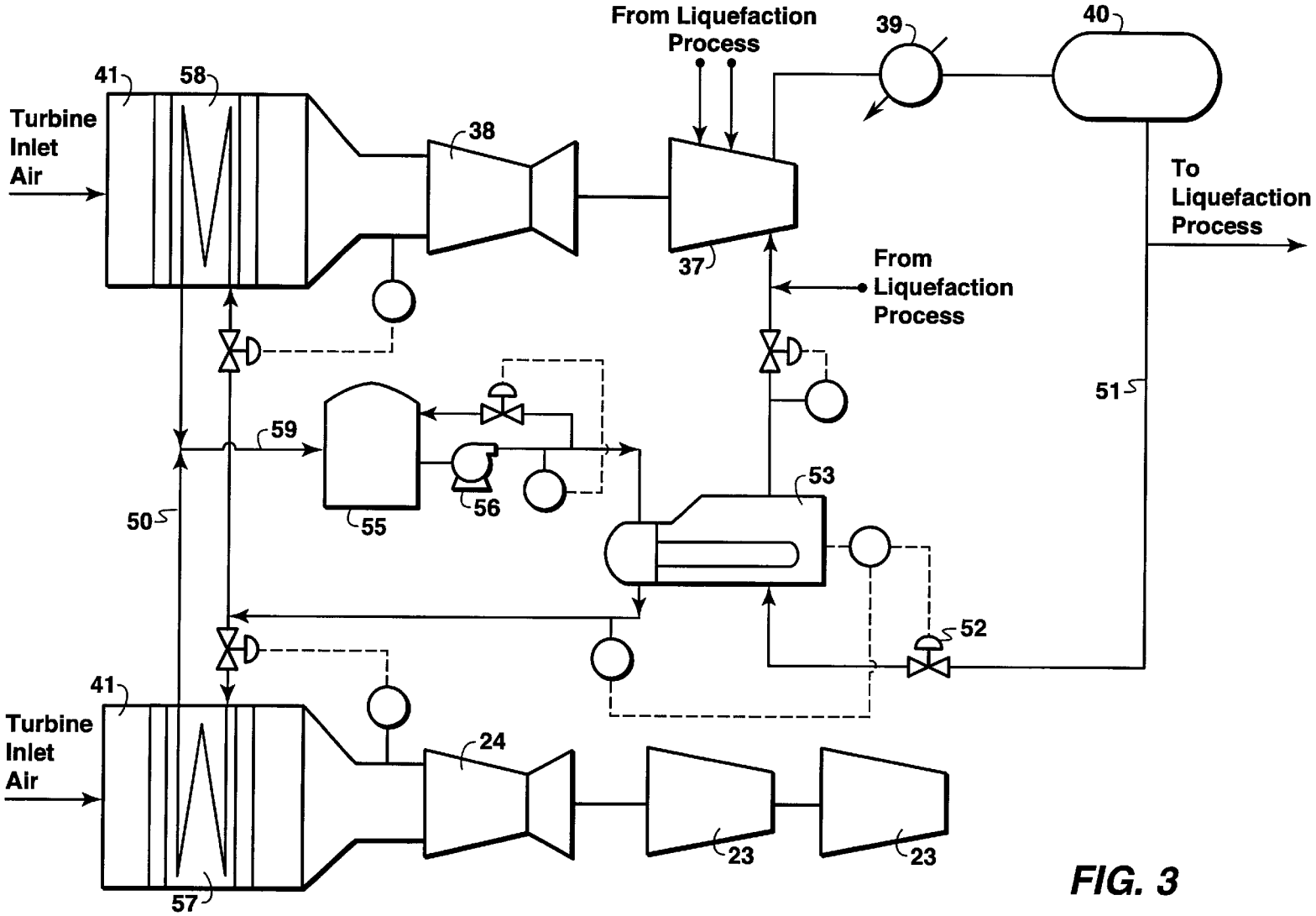
FIG. 3 is a more detailed view of the turbine inlet air cooling circuit of the system of FIG. 2.

Now referring to FIG. 2, in accordance with the present invention, means is provided in the typical system 10 of FIG. 1 for cooling the inlet air to both gas turbines 24 and 38 for improving the operating efficiency of the turbines. FIG. 3 is an enlarged view of the turbine inlet air cooling circuit of the system shown in FIG. 2. Basically, the cooling means in the present invention utilizes excess refrigeration available in a typical gasification system 10 to cool water which, in turn, is circulated through a closed, inlet coolant loop 50 to cool the inlet air to the turbines.

To provide the necessary cooling for the inlet air, refrigerant (e.g. propane) is withdrawn from first closed circuit 20 (i.e. from propane surge tank 40) through line 51 and is flashed across expansion valve 52. Since propane circuit 20 is already available in gas liquefaction processes of this type, there is no need to provide a new or separate source of cooling in the process thereby substantially reducing the costs of the system of this invention. The expanded propane is passed from valve 52 and through heat exchanger 53 before it is returned to propane circuit 20 through line 54. The propane evaporates within heat exchanger 53 to thereby lower the temperature of a coolant (e.g. water) which, in turn, is pumped through the heat exchanger 53 from a storage tank 55 by pump 56.

The cooled water is then pumped through coolers 57, 58 positioned at the inlets for turbines 24, 38, respectively. As air flows into the respective turbines, it passes over coils or the like in the coolers 57, 58 which, in turn, cool the inlet air before the air is delivered to its respective turbine. The warmed water is then returned to storage tank 55 through line 59. Preferably, the inlet air will be cooled to no lower than about 5° C. (41° F.) since ice may form at lower temperatures. In some instances, it may be desirable to add an anti-freeze agent (e.g. ethylene glycol) with inhibitors to the water to prevent ice from forming in the water coolant and to control corrosion.

By maintaining the inlet air for the turbines at a substantially constant low temperature, the amount of power generated by the turbines remains at a high level regardless of the ambient air temperature. This allows the LNG plant to be designed for more capacity and allows the plant to operate at a substantially constant production rate throughout the year. Further, since the present invention utilizes the propane circuit which is already present in LNG systems of this type, no addition cooling source is required to carry out the invention.

What is claimed is:

1. A method for processing natural gas to produce liquefied natural gas, said method comprising the steps of:

(a) cooling said natural gas in one or more heat exchangers using a first refrigerant from a first refrigerant circuit in which said first refrigerant is compressed in a first compressor driven by a first gas turbine having a first inlet air stream; and (b) liquefying said natural gas using a second refrigerant, which second refrigerant is compressed in a second compressor driven by a second gas turbine having a second inlet air stream, wherein at least one of said first and second inlet air streams is cooled with said first refrigerant from said first refrigerant circuit.

2. The method of claim 1 wherein at least one of said first and second inlet air streams is cooled to a temperature of no lower than about 5° C. (41° F.).

3. The method of claim 1 wherein said first refrigerant is propane.

4. A method for improving the efficiency of a process for producing liquefied natural gas, said process comprising the steps of (a) cooling said natural gas in one or more heat exchangers using a first refrigerant from a first refrigerant circuit in which said first refrigerant is compressed in a first compressor driven by a first gas turbine having a first inlet air stream and (b) liquefying said natural gas using a second refrigerant, which second refrigerant is compressed in a second compressor driven by a second gas turbine having a second inlet air stream, said method comprising cooling at least one of said first and second inlet air streams with said first refrigerant from said first refrigerant circuit.

5. The method of claim 4 wherein at least one of said first and second inlet air streams is cooled to a temperature of no lower than about 5° C. (41° F.).

6. The method of claim 4 wherein said first refrigerant is propane.

7. A system for liquefying natural gas comprising:

a first refrigerant circuit of a first refrigerant for initially cooling said natural gas;

a first compressor for compressing said first refrigerant as said first refrigerant flows through said first refrigerant circuit;

a first gas turbine for driving said first compressor, said first gas turbine having a first inlet air stream;

a second refrigerant circuit of a second refrigerant for liquefying said natural gas;

a second compressor for compress said second refrigerant as said second refrigerant flows through said second refrigerant circuit; and a second gas turbine for driving said second compressor, said second gas turbine having a second inlet air stream, wherein at least one of said first and second inlet air streams is cooled with said first refrigerant from said first refrigerant circuit.

8. The system of claim 7 wherein at least one of said first and second inlet air streams is cooled to a temperature of no lower than about 5° C. (41° F.).

9. The system of claim 7 wherein said first refrigerant is propane.

* * * * *